US006032717A

United States Patent [19]

Belgoff

[11] Patent Number: 6,032,717

[45] Date of Patent: Mar. 7, 2000

[54] AUTOMATIC AND ELECTROMECHANIC ROLLING DEVICE FOR CURTAINS

[76] Inventor: Anatolio Belgoff, Av. Altube3975, José C. Paz, Buenos Aires, Argentina

[21] Appl. No.: 09/025,300

[22] Filed: Feb. 18, 1998

[30] Foreign Application Priority Data

Feb. 18, 1997 [AR] Argentina ..... 97 01 06608

[51] Int. Cl.[7] ..... A47G 5/02

[52] U.S. Cl. ..... 160/309; 160/38; 160/243; 160/310; 185/7; 242/541.3

[58] Field of Search ..... 160/4, 263, 291, 160/309, 310, 243, 38, 346; 242/178, 333, 249, 390.9, 541.3, 918

[56] References Cited

U.S. PATENT DOCUMENTS

| | | | |
|---|---|---|---|
| 1,968,097 | 7/1934 | Roberts | 242/75 |
| 3,707,996 | 1/1973 | Zebley et al. | 242/75.2 X |
| 3,792,826 | 2/1974 | Zebley | 242/75.5 |
| 4,092,575 | 5/1978 | Ogishi et al. | 318/282 |
| 4,411,348 | 10/1983 | Fillion | 160/310 X |
| 4,438,656 | 3/1984 | Hayer | 185/4 X |
| 4,651,940 | 3/1987 | Nakamura | 160/310 X |
| 4,886,007 | 12/1989 | Wheeler | 114/102 |
| 4,930,768 | 6/1990 | Lapcevic | 272/117 |
| 5,447,477 | 9/1995 | Bresson et al. | 160/310 X |
| 5,533,214 | 7/1996 | Graham | 160/310 X |
| 5,709,349 | 1/1998 | De Chevron Villette et al. | 160/309 X |
| 5,848,634 | 12/1998 | Will et al. | 160/310 |

*Primary Examiner*—Jerry Redman
*Assistant Examiner*—Bruce A. Lev
*Attorney, Agent, or Firm*—Jacobson, Price, Holman & Stern, PLLC

[57] ABSTRACT

A rolling device that is fixed to a laminar material and is capable of rolling and unrolling the laminar material arranged around a shaft of the device, the device including an arm normally extending from the shaft and freely rotatably connected to the shaft, the arm including a motor to rotate the shaft.

2 Claims, 1 Drawing Sheet

AUTOMATIC AND ELECTROMECHANIC ROLLING DEVICE FOR CURTAINS

FIELD OF THE INVENTION

This invention consists of a rolling device for curtains, whose novelty is focused on the combination of necessary elements, which have not been obtained yet.

This machine makes a horizontal shaft revolve by means of a motoreducer and a transmission as if it were a lathe, all these elements acting as a lever, perpendicular to this shaft thus bringing about tangentially a force to lift or lower the weight of the curtain system.

Its basic aim is to roll curtains automatically, these being programmed or manual, which are used to control passage, to ventilate or to shade different rooms.

The invention of this machine arises from the need to roll curtains used in greenhouses in particular (a place covered and sheltered to protect plants from cold).

BACKGROUND OF THE INVENTION

The fact that these greenhouses used to grow ornamental species, fruit and crops are made of very transparent material such as polyethylene film, glass, etc, thus letting sunlight in them almost completely raises the inner temperatures at daytime, even more during summer, resulting in great losses of crops.

This permanently urges the producers to find an efficient and economical way to ventilate.

The way to let air in is through lateral and zenithal openings, the latter being the most effective one, as it allows the free convection of warm air which remains in the upper part of the greenhouse, letting it out as a chimney does.

Up to now, all the buildings which use this type of ventilation are very expensive, not affordable to many producers, and in some cases they are replaced by big electric air extractors, which as it is known, consume a lot of energy.

This device allows you to build a compact, plain, economical and efficient system for any kind of structure.

All greenhouses have parabolic, equilateral, hacksaw teeth and A-sloped roofs, which do not let the rolling devices known so far work upon them, as they only work rolling curtains vertically and they always slide on a straight guide, which leads them and lets them get the application points from the reaction forces of the torque, which is needed for rolling.

The stroke limits used up to now, are external keys or internal mechanisms based on gearing revolution counters, coil clutches, all these being difficult to be kept up, as this sort of plant growth is well known for the use of great moisture, heat and corrosive chemical compounds, which usually causes faults.

SUMMARY OF THE INVENTION

This new device does not require a complementary guide, as it gets its torque from its own weight as a reaction force and its structure as a handle of the lever perpendicular to the shaft that makes the motoreducer revolve, thus causing the required moment to roll the curtain on which it stands.

It can work as a rolling device travelling through straight or bent inclined planes located in roofs, leaning against them without any further guide being necessary, covering or opening them to ventilate or to shade them easily according to the needs. Additional keys built separately are not needed for the stroke limits as it is equipped with contacts inside which act at each level, sealed units which do not need to be kept up, which are activated at the different angles that the device makes with the vertical line when it reaches the extremes of the distance traveled, when it cannot keep rolling on the shaft where the curtain is rolled, it stops; this device keeps revolving around its work shaft and the contact which stops the motoreducer is hence activated. The same occurs for both extremes, however, it may need different stop angles, which are previously adjusted for each particular case.

These limits are also used for safety, in case any difficulty arises, the device forms a greater angle to the vertical line and it stops, preventing it from keeping on rolling on the distance to be traveled and thus not causing any breakage due to overwork.

DETAILED DESCRIPTION OF THE PREFERRED EMBODIMENTS

This machine was meant to hang, as seen in drawings 1,2,3, having its rotation center in shaft "A" (FIG. 1), which is activated by means of a motoreducer and a transmission "B" mounted in an arm E normally extending from shaft A and freely rotatably connected to shaft A at its end within sleeve F.

Figure 2:
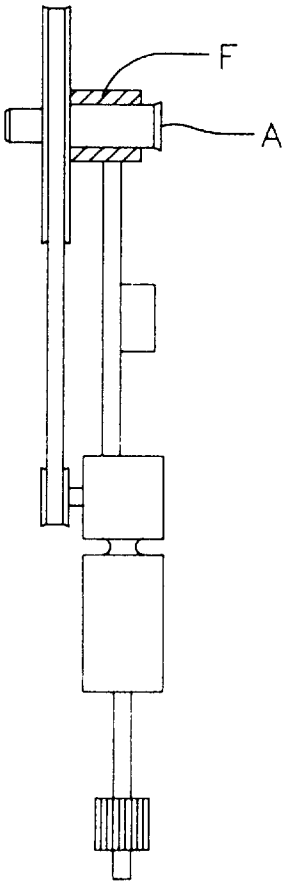
FIG. 2 shows a side elevational view of the device of FIG. 1.
Figure 1:
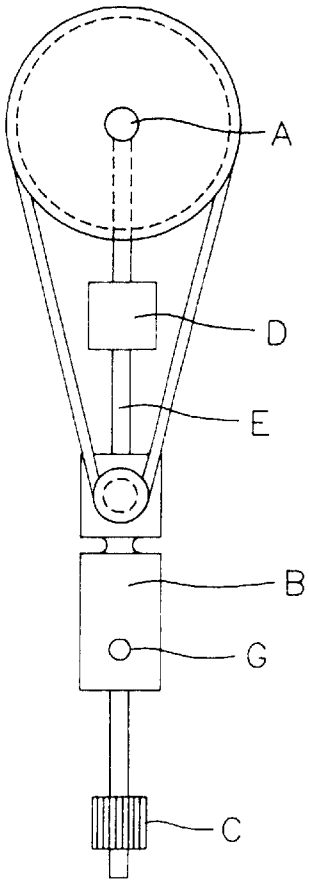
FIG. 1 shows a front elevational view of the device of the invention.

As stated above, the device of the invention may travel along straight or inclined planes, such as roofs, as indicated by the arrows in FIG. 1, by rotating the shaft over the curtain through a simple motoreducer and transmission B to a shaft A, such as by a pulley-belt-pulley arrangement as illustrated in FIGS. 1 and 2.

Figure 3:
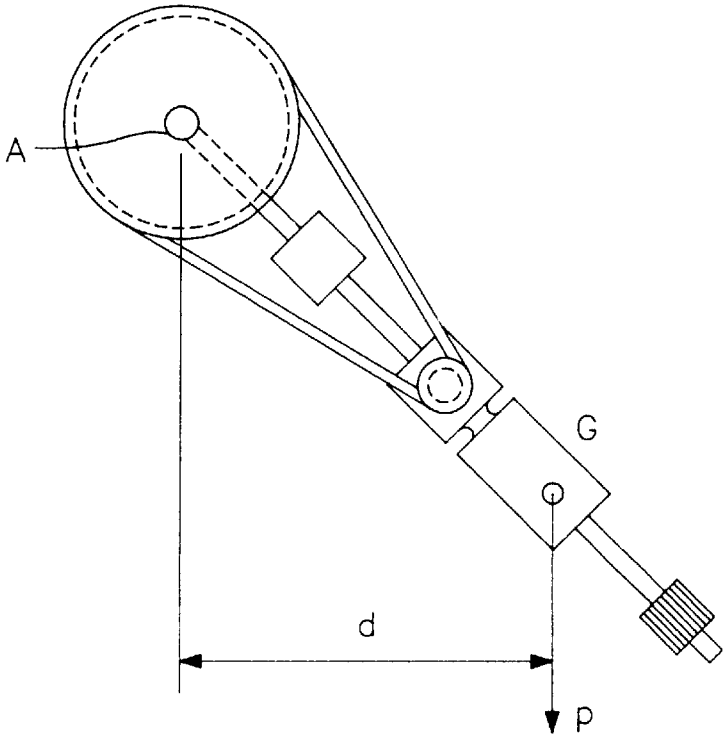
FIG. 3 is a view similar to FIG. 1 but with the device inclined relative to a vertical axis.

This machine hangs, as seen in FIGS. 1, 2 and 3 having its rotation center in shaft "A" which is actuated by motoreducer and transmission B mounted in arm E normally extending from shaft A and freely rotatably connected at end of shaft A within sleeve F.

As it is known, the moment of a force is equal to the product of the force by a distance, where in this case the force is the weight "P" (FIG. 3) (of the device) applied to its center of gravity "G" (FIG. 3) and the distance "d" (FIG. 3) is the projection of the angle made by a straight line between the centre of gravity "G" (FIG. 3) and point corresponding to shaft "A" (FIG. 3) (where the moment is applied) with the horizontal line.

The weight "P" is made up of the mass of all the components needed to make it work, plus an additional "C", which can be extended (FIG. 1) and added if necessary, moving it away from the rotation point "A", in order to change distance "d" (FIG. 3) thus obtaining an adjustable torque according to the different cases that may appear.

Furthermore it contains an electrical circuit made of a set of elements and two contacts for each level, consisting of shielded mercury blisters or any other thing that may replace them, all these inside a box of electrical commands "D" (FIG. 1).

The adjustment of these levels allows the inventive device to take different stop angles, in both directions, as to the vertical line.

Therefore the possibilities of calibrating the torque are widened when changing distance "d" (FIG. 3).

Having described and set forth the nature and the scope of this invention and the way in which the same has to be put into practice, it is hereby declared that what is claimed as an invention and sole ownership of the above mentioned consists of, I claim:

1. A self-powered device for rolling and unrolling a laminar material, the device comprising:

a rotating shaft for supporting laminar material connected thereto, a sleeve surrounding the rotating shaft, the rotating shaft rotates within said sleeve, an arm connected to the sleeve and extending at an angle that is normal to the shaft, a motor mounted on the arm and connected to the shaft by a transmission rotatably actuating the shaft, and a weight movably mounted along the arm to vary a torque between the weight and the shaft.

2. A self-powered device for rolling and unrolling a laminar material as claimed in claim 1, wherein the arm is connected to an end of the shaft.

* * * * *